US005193313A

United States Patent [19]

Sanchez et al.

[11] Patent Number: 5,193,313

[45] Date of Patent: Mar. 16, 1993

[54] VACUUM SANDER

[75] Inventors: Angelo Sanchez, New City; Michael J. Ferdinand, Pearl River; Robert J. Buchalski, Jr., Washingtonville, all of N.Y.

[73] Assignee: Partnership of Angelo Sanchez, et al., New City, N.Y.

[21] Appl. No.: 811,851

[22] Filed: Dec. 23, 1991

[51] Int. Cl.[5] ..... B24B 23/00

[52] U.S. Cl. ..... 51/170 R; 51/180; 51/273; 51/392

[58] Field of Search ..... 51/170 R, 174, 391, 51/180, 392, 273, 393; 15/396, 421

[56] References Cited

U.S. PATENT DOCUMENTS

| | | | |
|---|---|---|---|
| 4,062,152 | 12/1977 | Mehrer | 51/170 R |
| 4,158,935 | 6/1979 | Robert | 51/273 |
| 4,164,101 | 8/1979 | Robert | 51/273 |
| 4,759,155 | 7/1988 | Shaw | 51/180 |
| 4,779,385 | 10/1988 | Reiter | 51/180 |
| 4,839,995 | 6/1989 | Hutchins | 51/170 MT |
| 4,937,984 | 7/1990 | Taranto | 51/180 |
| 4,964,243 | 10/1990 | Reiter | 51/180 |
| 5,007,206 | 4/1991 | Paterson | 51/180 |
| 5,036,627 | 8/1991 | Walters | 51/180 |

*Primary Examiner*—Roscoe V. Parker
*Attorney, Agent, or Firm*—Stanley J. Yavner

[57] ABSTRACT

A hand or automatically vibrating sander head is connected to a vacuum system and defines an air flow intake pattern on a plate in order to efficiently and conveniently provide for the disposal of sanding remains.

1 Claim, 5 Drawing Sheets

FIG. 2
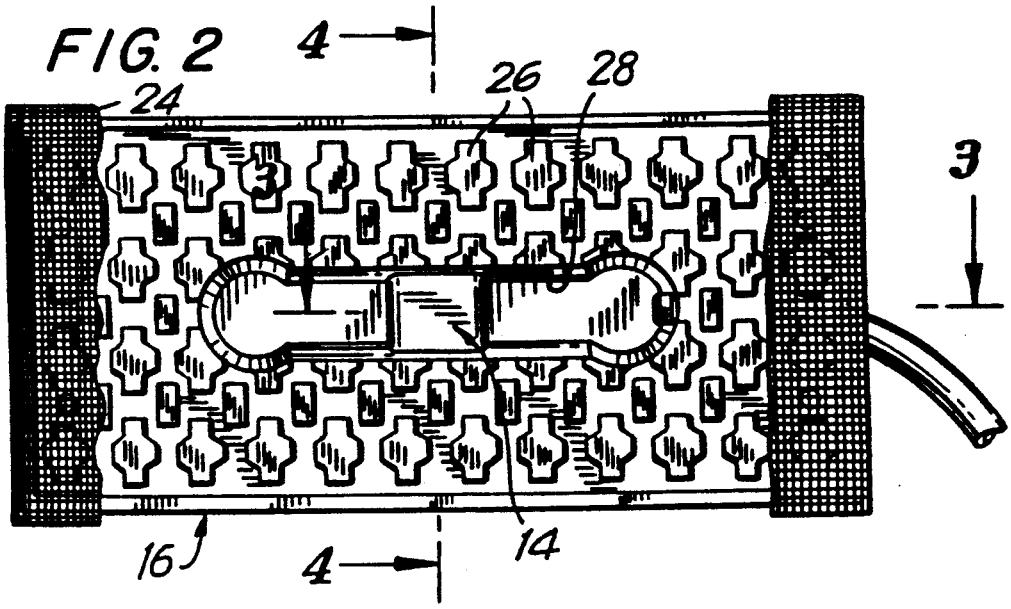
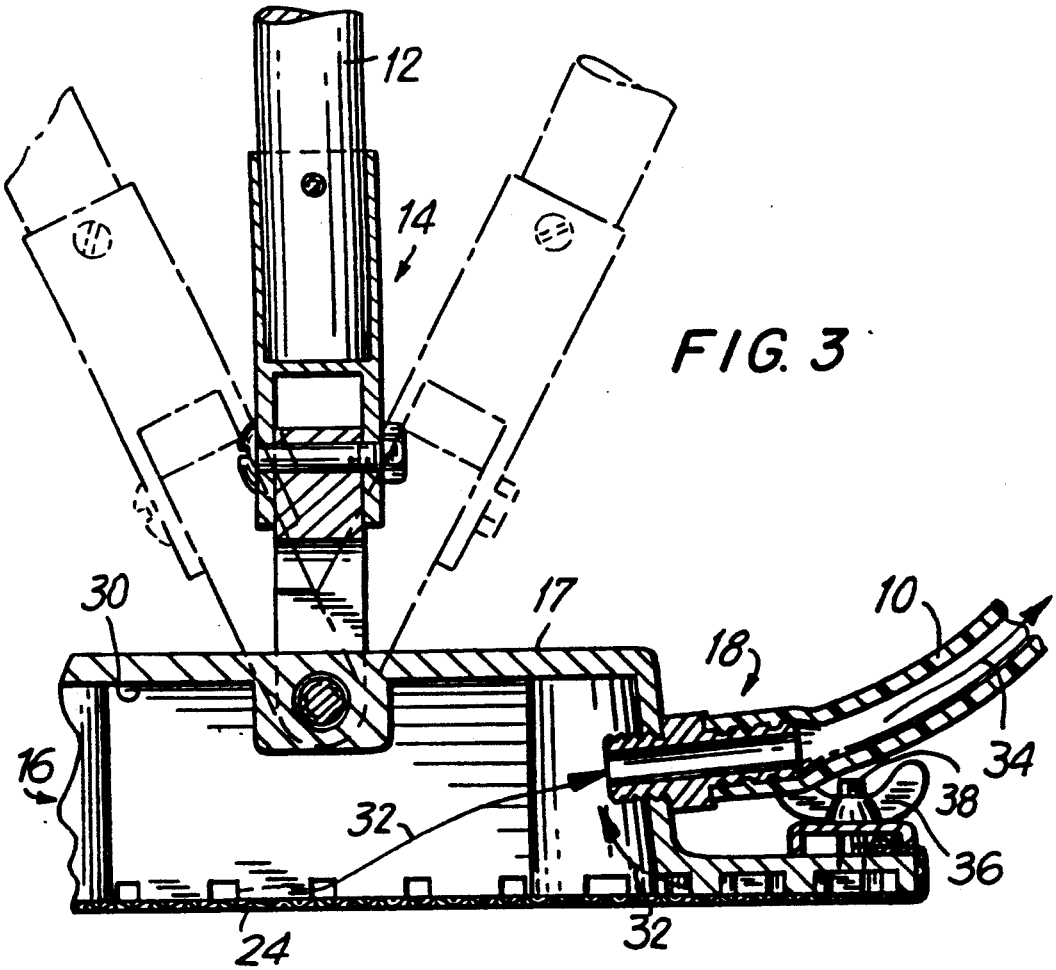
FIG. 3

FIG. 4
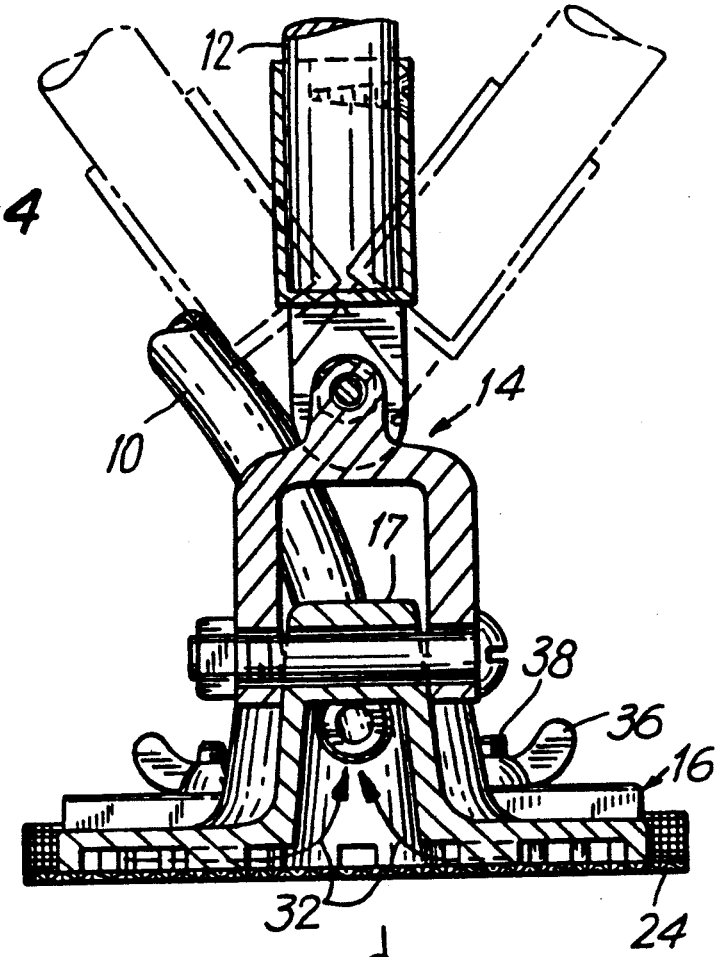
FIG. 5
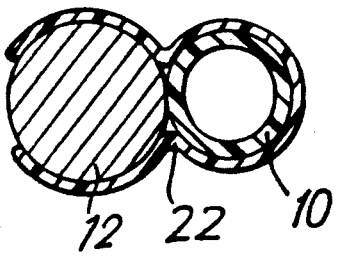
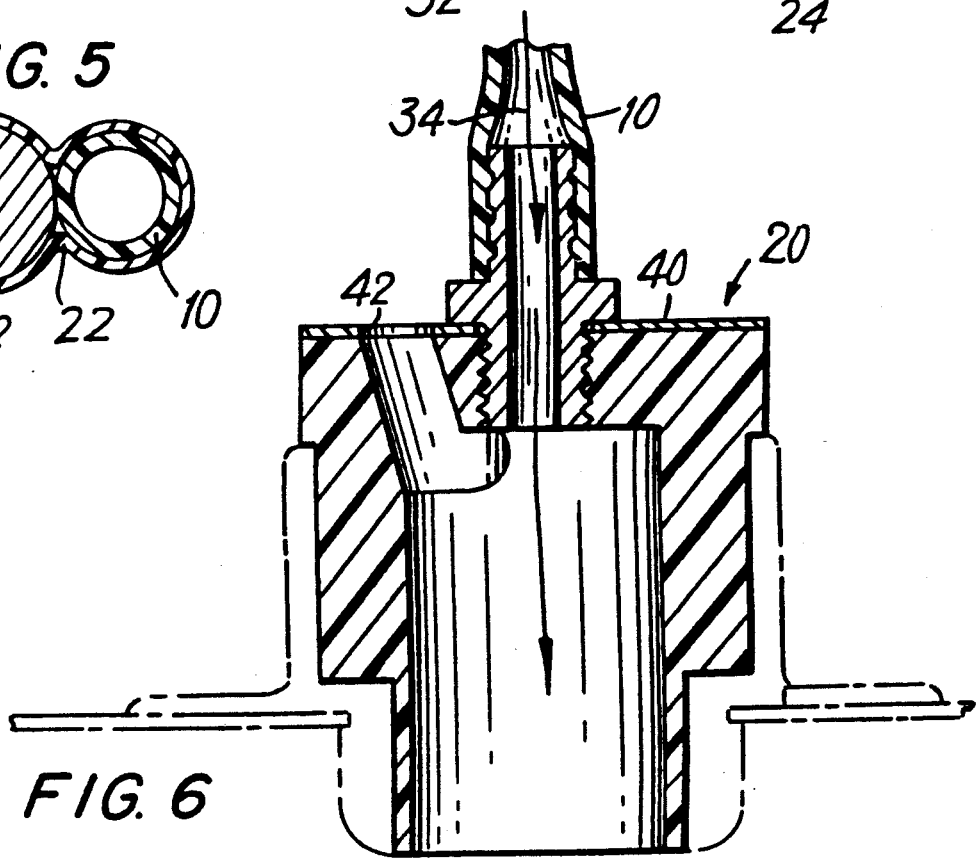
FIG. 6

FIG. 7
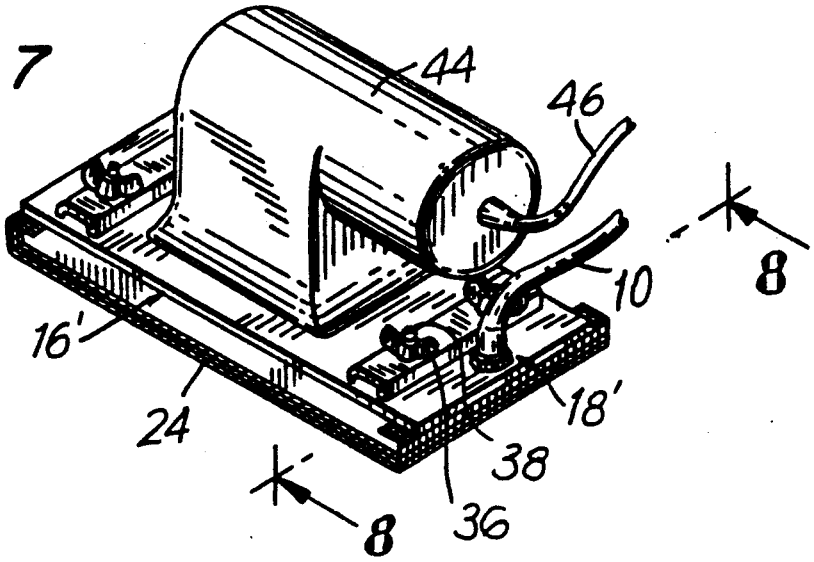
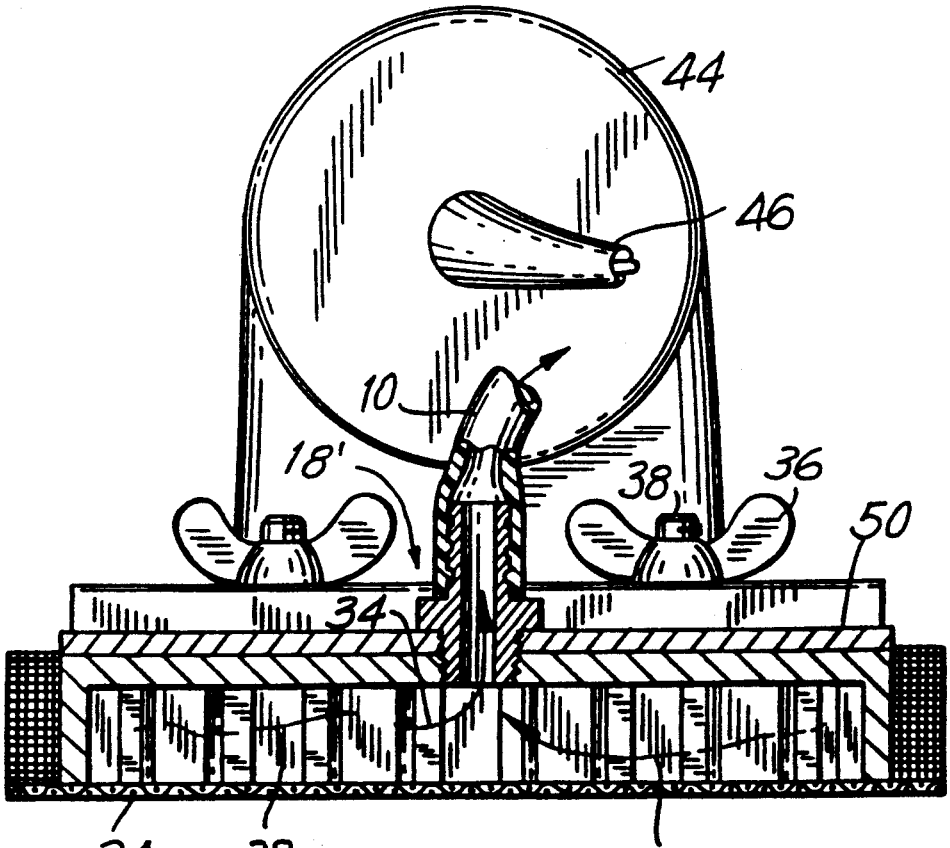
FIG. 8

VACUUM SANDER

FIELD OF THE INVENTION

This invention relates primarily to sander constructions and more particularly to manual and automatic sander constructions with a facility for vacuuming the sanding remains.

PRIOR ART AND BACKGROUND OF THE INVENTION

For many years carpenters, sheet-rockers, auto body sanders, tapers, etc. have attempted to cope with the problem of disposing conveniently of the remains of a sanding operation. Of course, a sanding operation typically ends with a large volume of sanding remains in the work area, both on the work surface and in the air. For many years, one of the common methods of disposing of the sanding remains related to a separate, after-operation vacuuming process for the work surface and the floor around the work surface. For this purpose, a large variety of "industrial-strength" vacuum systems have been designed and developed. After all, the vacuum system had to cope with more than the usual dust and the like found in the home environment. Most importantly, such "industrial-strength" vacuum systems did a fine job on the work surface and other proximate surfaces, but did nothing for the sanding remains spread throughout the air in the work place. Commonly, this subjected the person doing the sanding to lung and other health hazards, both during the sanding operation and thereafter.

More recently, inventors such as Shaw, U.S. Pat. No. 4,759,155 have developed methods and apparatus which involve a plurality of holes in a sanding plate underlying the sand paper, which was designed with a porous material. In this way, the sanding remains are vacuumed during the sanding operation into a vacuum plenum, and this prevents, for the most part, the dispersing of sanding remains into the air of the work place. However, the pattern of openings to the plenum and vacuum system in the underlying plate prove less efficient than it could be in gathering all of the sanding remains as the sanding operation proceeds. Also, the plenum tends to clog up.

Similarly, Taranto, U.S. Pat. No. 4,937,984 issued on Jul. 3, 1990, designed a similar, but square hole pattern for the underlying plate.

All of these systems, exemplified by Shaw and Taranto, do not present an apparatus for the purpose of cleaning sanding remains, which proves to be as simple, efficient and convenient as the present invention. Also, the construction is different.

SUMMARY OF THE INVENTION

Accordingly, a primary object of the present invention is to provide an apparatus for performing a clean-up operation during a plaster, joint compound, auto-body filler, or the like, sanding procedure, which is efficient, convenient and yet simple in its construction and operation.

A further and more particular object is to provide a sanding apparatus, which cleans sanding remains during a sanding operation, is conveniently coupled to a vacuum system and can be used with a hand or automatic electric sander.

These and other objects of the present invention are accomplished in a sanding system which features a flat, chamberless sanding subplate defining a central opening for input of the sanding remains, a pattern of airflow buffers for directing the flow of sanding remains to said opening and a coupling output opening to a vacuum system. Also, a vacuum flow hose, leading from said coupling output opening, terminates at its other end in a variable airflow vacuum plug. A handle is coupled to the plate in a convenient and efficient manner, so that the plate can be easily manipulated; or the handle can be removed for manual use. A porous sandpaper is attached over the buffer pattern, so that sanding remains are more efficiently directed to the vacuum system through the plate.

BRIEF DESCRIPTION OF THE DRAWINGS

Other objects, features and advantages of the present invention will become apparent from the following detailed description of the preferred, but nonetheless, illustrative, embodiment and alternative embodiment of the present invention, with reference to the accompanying drawings, wherein:

FIG. 2 is a bottom, sectional view of the plate thereof, taken along the line 2—2 of FIG. 1;

FIG. 3 front, sectional view of the plate and vacuum hose coupling, and handle connection for the apparatus of the present invention, taken along the line 3—3 of FIG. 2;

FIG. 4 is a left side, sectional view of the plate and handle connection of the present invention, taken along the line 4—4 of FIG. 2;

FIG. 5 is a top sectional view taken along the line 5—5 of FIG. 1, and showing particularly the vacuum hose anchor of the apparatus hereof;

FIG. 6 is a top and right side sectional view taken along the line 613 6 of FIG. 1 and showing particularly the construction of the adjustable airflow vacuum hose plug thereof;

FIG. 7 is a front and right side isometric view of an alternative embodiment of the present invention and particularly showing an automatic vibration apparatus therefor, as well as a vacuum hose coupling therefor; and FIG. 8 is a right side, sectional view, taken along the line 8—8 of FIG. 7, and showing particularly the vacuum hose connection for the plate thereof.

DETAILED DESCRIPTION OF THE INVENTION

Figure 1:
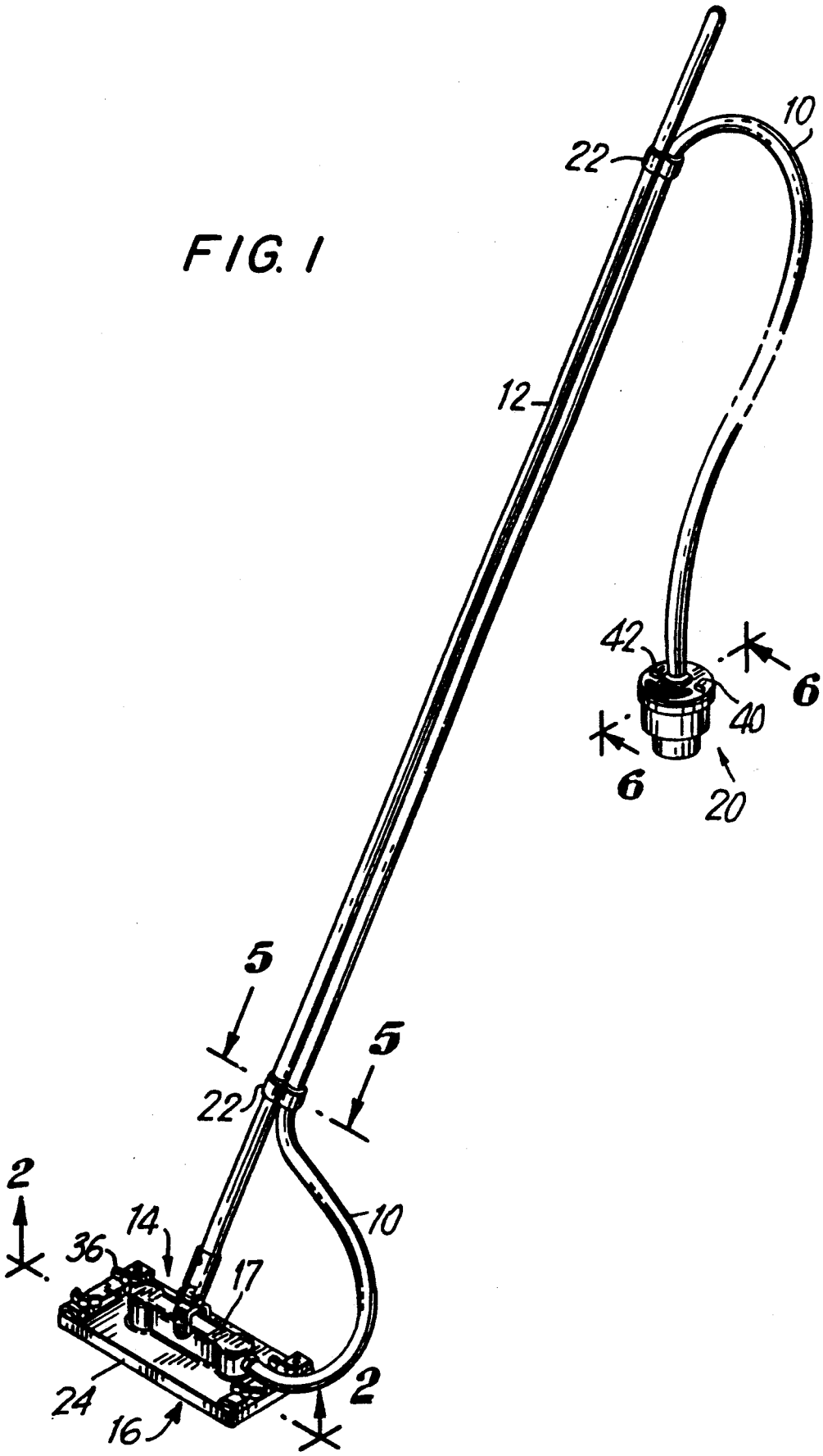
FIG. 1 is a front and right side isometric view of a vacuum sander according to the present invention.
Figure 1A:
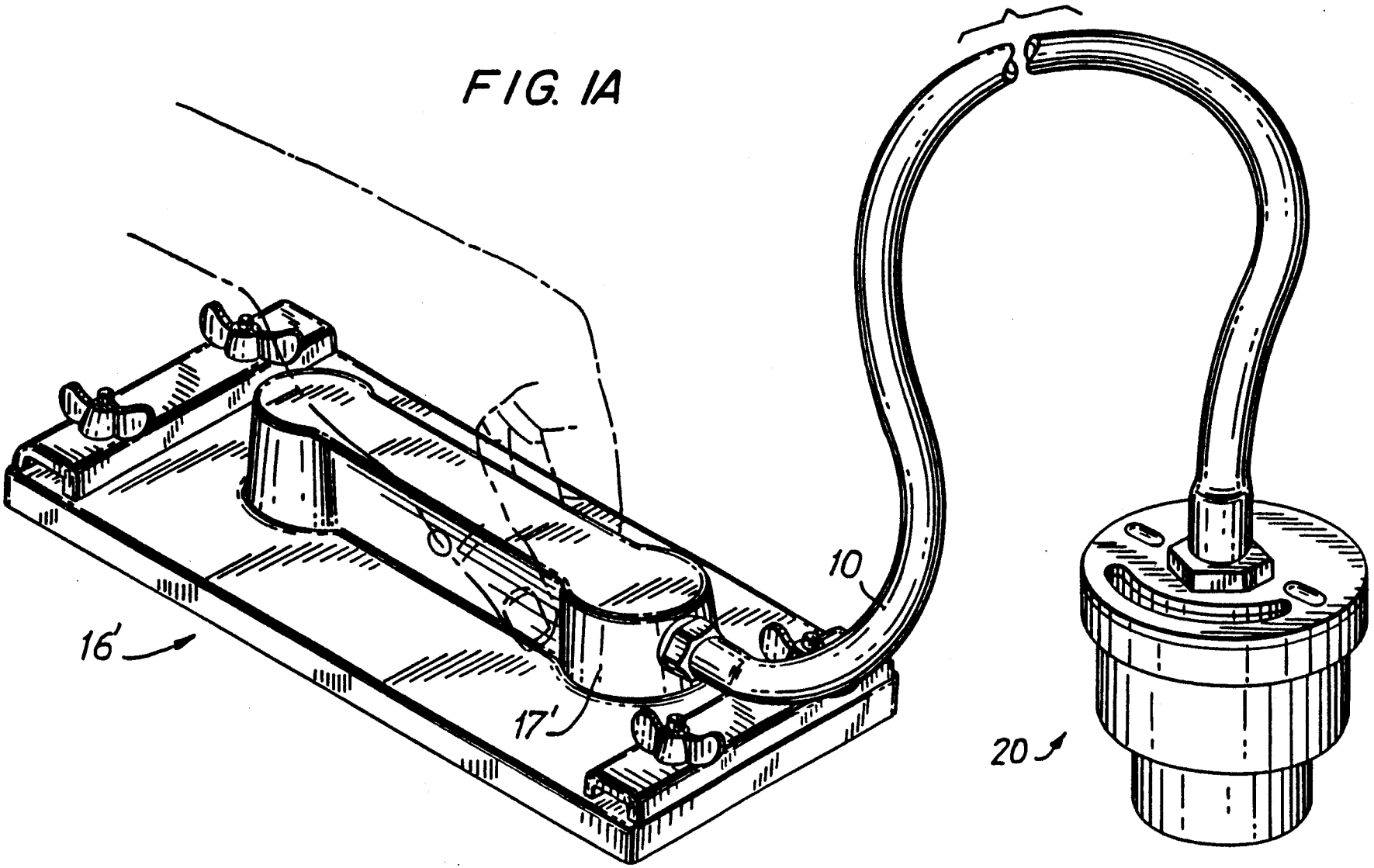
FIG. 1A is a front and right side isometric view of the sander of FIG. 1, showing a hand-held alternative embodiment thereof.

Referring to the drawings, particularly FIGS. 1–6 thereof, a vacuum sander, according to the preferred embodiment of the present invention, is shown to include a vacuum flow hose 10 a handle 12, a handle coupling, generally designated 14, a base plate generally designated 16, a hose coupling generally designated 18, a hose plug generally designated 20 at the other end of the hose, and vacuum hose anchors 22.

Generally, a base plate 16 is covered with a sanding screen 24 in the design of the present invention. A pattern of buffers 26 is defined by the underside of base plate 16, such that when the vacuum negative pressure is instituted, the sand remains from the operation are efficiently guided into a central hole 28 defined on the underside of base plate 16. Opening 28 leads, by way of passage 30 to the hose coupling 18, in the direction shown by the arrows 32 (FIG. 3). Thus, the vacuum conducts the sand remains from the project through hose 10 in a direction represented by arrows 34.

Screen 24 is coupled to the base plate 16 by means of wing nuts 36 and bolts 38, or the like.

Handle 12 is attached by handle coupling 14 to the base plate 16 proximate passage 30. Securement of hose 10 to handle 12 is further provided by means of one, two or more anchors 22, so as not to allow hose 10 to interfere, or cause a hazzard, during the sanding operation being performed.

At the other end of hose 10, plug 20 enables convenient coupling of the hose to a vacuum system and provides an adjustable airflow capability by means of turn-plate 40 and opening 42 defined thereby.

By disengaging handle coupling 14, a hand-held embodiment for wall sanding is presented as 16' in FIG. IA. In this manner, upwardly extending structure 17' becomes the handle means, rather than simply to define passage 30, as is accomplished by structure 17 in FIGS. 1–6.

In order to provide a complete description of the preferred embodiment of the present invention, a series of use steps are now provided. By use of handle 12, tilting in directions indicated by ghost lines shown in FIG. 3, a manual sanding operation is provided, with the sanding screen 24 on base plate 16. During the entire operation, plug 20 is coupled to a vacuum source, and plate 40 continuously adjusted so that the airflow required is continuously provided. A convenient, efficient and yet simple manual sanding operation is thereby enabled, with the amount of surface dispersement of the sanding remains and the amount of sanding remains dispersed into the air of the work place being greatly reduced.

Referring to the alternative embodiment of FIGS. 7 and 8, a vibrating motor 44, or the like, is provided at the top side of base plate 16', the base plate providing a back coupling 18' to hose 10. Of course, coupling 18' in the alternative embodiment may be with exactly the same construction as the preferred embodiment; whereby, location 50 may be used to couple hose 10 to a central hole 28' (not shown) from the area of buffers 26 in the base plate. Also, vibrator 44 is electrically connected by means of wire 46 or the like to an appropriate electrical source. Thus, as shown in FIG. 8, sand remains are guided up through screen 24, in the direction of arrows 32 and 34, to the vacuum source. The embodiment of FIGS. 7 and 8 is used with or without the pole 12 described with reference to the preferred embodiment. If pole 12 is not used, vibrator 44 is grasped manually by the carpenter using the invention.

Otherwise, the alternative embodiment operates in a manner similar to that described with reference to the preferred embodiment.

Accordingly, the foregoing description does not limit the extent of the present invention, which instead, is to be confined and limited only by the following claims:

What is claimed is:

1. A vacuum sander for use in connection with a source of negative pressure comprising a flat chamberless base plate, the underside of which defines a plurality of buffer extensions and a central opening, an elongated handle pivotably coupled to said base plate, a vacuum hose leading to said source, means for providing a hose coupling to said central opening, and a plug for coupling said hose to said source, said plug having an adjustable plate defining means for adjusting airflow therethough.

* * * * *